US005879007A

United States Patent [19]

Kasri

[11] Patent Number: 5,879,007

[45] Date of Patent: Mar. 9, 1999

[54] SIMPLIFIED GAME OF CHANCE AND SKILL

[76] Inventor: Omar Kasri, 16015 Jalon Rd., La Mirada, Calif. 90638

[21] Appl. No.: 967,802

[22] Filed: Nov. 12, 1997

[51] Int. Cl.[6] ..... A63F 1/00

[52] U.S. Cl. ..... 273/292

[58] Field of Search ..... 273/292, 274, 273/309

[56] References Cited

U.S. PATENT DOCUMENTS

| | | | |
|---|---|---|---|
| 5,538,252 | 7/1996 | Green | 273/292 |
| 5,549,300 | 8/1996 | Sardarian | 273/292 |

OTHER PUBLICATIONS

County of Los Angeles, Sheriff's Department Headquarters, "Rules of California Catch 22". Mar. 1995.

*Primary Examiner*—Benjamin H. Layno

*Attorney, Agent, or Firm*—Bruce A. Jagger

[57] ABSTRACT

The game is played by a minimum of two players, an action player and a banker player. A dealer administers the game. A banker player outlays a maximum amount he is willing to risk, establishing a bank. Cards are dealt with the object of obtaining special hands or an aggregate score of a predesignated number. If a players aggregate total exceeds the predesignated number his score is adjusted by subtracting a fixed numeric value. Hence, every player has a chance to win even when going over the predesignated number. Wagers are settled between the banker player and the other players by application of an order of prevalence. If the banker player loses, the banker satisfies the extent of the actions player's wager from the proceeds in the bank. If the banker player wins, he receives the wager of that player. Play ends when either the bank is depleted or when all wagers have been settled.

18 Claims, 2 Drawing Sheets

SIMPLIFIED GAME OF CHANCE AND SKILL

BACKGROUND OF THE INVENTION

1. Field of the invention

The invention relates in general to a game of chance and skill and, in particular, to such a game to be played in a wagering environment which, at all times, utilizes unique rules that apply an order of prevalence between a banker player's hand and action player's hand to determine a winner, and includes unique playing pieces of which any value may be assigned thereto.

2. Description of Related Art and Other Considerations

Various wagering games have been proposed wherein the players play against the "house" or another player who is acting as a "banker". To be successful, such games must not only hold the interests of the players as noted in Nelson et al U.S. Pat. No. 5,411,268, but they must also have rules that potential players can quickly learn, and move at a relatively fast pace. Attention is invited to Richard L. Frey, rev., "The New Complete Hoyle Revised" (New York:Doubleday, 1991), 3–14, 513–527, 541–548, which is hereby incorporated herein by reference, for a detailed description of various recognized forms of card games, including the game Blackjack.

The game of Blackjack is a fast moving game that has easily learned straightforward rules, however the game generally requires very little skill on the part of the player. For instance, in Blackjack, a player may choose additional cards in an effort to obtain twenty-one, however once the player goes over twenty-one there is no possibility for that player to win. Because of this, the game of Blackjack inherently contains the undesirable characteristic of loosing the interest of many players since going over a predesignated number, such as twenty-one, results in the impossibility of winning. Hence it is desirous to eliminate this characteristic.

However, in eliminating this characteristic it is desirous to, among other things, maintain easily learned rules, otherwise participation of new players is discouraged. This occurs because, as the rules of a game become more complex, the "learning curve" of a game increases, which, in turn, discourages participation of new players who refuse to take the time to learn the rules. Hence there is a need for a game of chance and skill that, among other things, eliminates the impossible win situation while, at the same time, maintains easily learned rules.

The problem of devising an easily learned, fast moving game, wherein the combined elements of play are presented so as to maintain a high degree of interest in the players has generally eluded previous workers in this art. Those concerned with these problems recognize the need for an improved game. These and other problems have been overcome according to the present invention.

BRIEF SUMMARY OF THE INVENTION

The playing pieces according to the present invention comprise, for example, cards, tiles or any equivalent media which have a display thereon of numbers, letters, designs and the like that are capable of establishing an order of prevalence for enabling a selection of two or more playing pieces to prevail over another selection of two or more playing pieces. Most commonly, for example, a standard 52 card deck is used with the Jokers removed from the deck. Included in the card deck are special cards. The special cards can be jokers, if desired. Multiple decks can be combined, generally eight to twelve decks, to reduce the delay incurred when the pieces need to be re-shuffled. There can be a few as two special cards, or as many as eight special cards per deck when multiple decks are combined. There may be as many participants as desired; however, a minimum of two players, in addition to the non-player dealer, is required. Of the participants, one is selected as the banker player and another as the action player, both being guests of the gaming house, both being preferably selected by some random method. Preferably, a third participant, an employee or member of the gaming house, is responsible for administering the proper play of the game, including dealing and exposing the playing pieces, but generally does not actively participate in wagering.

The banker player, for example, establishes a bank by placing a maximum risk amount he is willing to risk to lose to the other players. The other players then place their own wager which they are willing to risk to lose to the banker player. The dealer then, for example, deals one card face down to the banker player and one card face up to all other players. The dealer then, for example, deals a second card face up to all players. At this time all the players, with the exception of the banker player, can generally request additional cards, as desired, in a random order such as, for example, clockwise or counterclockwise starting from a player next to the banker player, in an attempt to achieve a combined total of a predetermined number. Preferably the predetermined number is, for example, twenty-one, or higher. The dealer then turns over the "down" card of the banker player. In one embodiment, the action token is given to one of the players according to the value of the banker players "down" card and this player is thereby designated the action player. The banker player can then request additional cards, according to predetermined rules, in an attempt to achieve the predesignated number. Preferably, the banker player, for example, must take a card when his total is less than seventeen, cannot take a card when his total is greater than eighteen, and has the discretion to take a card when his total is either seventeen or eighteen.

The action player's wager is first settled with the banker player according to an order of prevalence established between their hands, and then the other player's wagers are settled with the banker player in a random order such as clockwise or counterclockwise starting from a player next to the action player. It is significant to the present invention that wagers are settled according to rules which always allow for the possibility that a player's hand can win, even when their aggregate total exceeds the predesignated number. In one embodiment of the order of prevalence, holding just two special cards prevails over all hands, holding one special card and one ace prevails next over any other hand. Any aggregate score hand totaling the predetermined number, for example, twenty-one, prevails next over any other hand, and the highest value hand prevails over any lower value hand. When the banker player's hand and any player's hand are of the same order of prevalence, a "push" may, for example, be declared and neither player wins or losses their wager. In determining the value of any player's hand, for example, a value of one or eleven points is assigned to ace cards, a value of ten is assigned to face cards, face value is assigned to numeric cards, and any desired value is assigned to special cards. Hence, having one special card with any other card(s), except the ace, is an automatic aggregate score of the predesignated number, for example, twenty-one. If the aggregate total of any players hand exceeds, for example, twenty-one, the aggregate score of that player's hand is the aggregate total minus ten. Hence, the aggregate score of all the hands is never greater than the predesignated number, for example, twenty-one, which always allows for the possibility of winning against the banker. In another embodiment of the order of prevalence, having an ace card and a special card is treated the same as any aggregate score totaling the predesignated number, for example, twenty-one.

Once the wager has been settled between the action player and the banker player, the settlement between all other players and the banker player occur in a sequential order, such as clockwise or counter-clockwise, starting from the action player. When the banker player wins, the wager of the player is given to the banker player. When the banker player loses, an amount equal to the wager of the player is withdrawn from the bank and given to that player who also keeps his wager. The game is over whenever the maximum risk amount or bank is empty or when all wagers have been settled. In some jurisdictions, the banker player may only win (or lose) an amount equal that which he has placed in the bank, and when this occurs the game is over. Being the action player is advantageous because his wager is first settled with the banker player, when the bank is not empty. After all wagers have been settled, the banker player can decide to continue to play as the banker player, decide to become one of the other players, or terminate play.

The gaming house is preferably not an active player. As such, the usual situation where the odds are in the favor of the actively participating gaming house is avoided. However, in some jurisdictions, the gaming house could participate the banker player. Preferably, according to the present invention, the banker player enjoys odds slightly more favorable than those of the other players, however randomly selecting the banker player evenly distributes these odds, and overall, assists in retaining the interest of the players. In addition, before the banker player receives additional cards, it is impossible for a player to be in the situation where he has no possibility of winning. Also, the rules are designed to be straightforward and easy to learn in order keep the "learning curve" for the game down so as to minimize discouragement of new player participation.

Other aims and advantages, as well as a more complete understanding of the present invention, will appear from the following explanation of exemplary embodiments and the accompanying drawings thereof, which are described for the purposes of illustration, and not limitation.

DETAILED DESCRIPTION OF THE PREFERRED EMBODIMENTS

Figure 1:
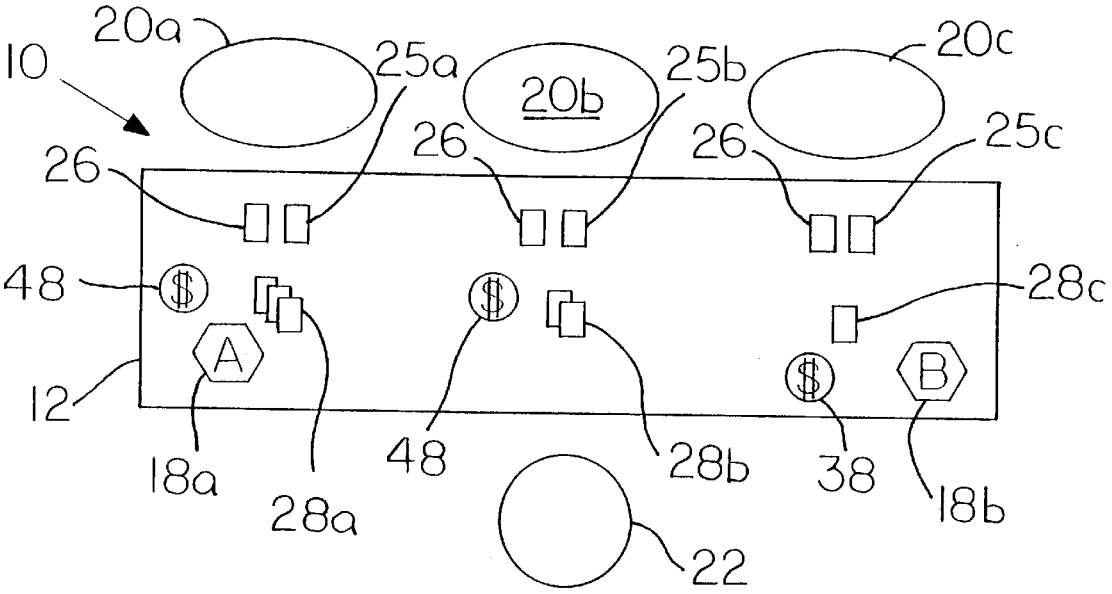
FIG. 1 is a view of a typical set up for playing the game of the present invention.
Figure 3:
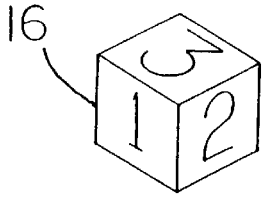
FIG. 2–4 illustrate examples of playing pieces, markers, and a selection device.
Figure 4:
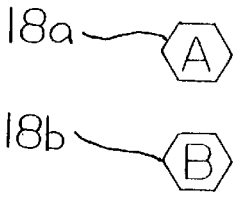

The physical paraphernalia or equipment and articles used in the present invention, as generally illustrated by numeral 10 in FIG. 1, include a gaming table 12 (FIG. 1), playing pieces or cards generally illustrated by numeral 30 (FIG. 2), a random selection device 16 (FIG. 3), and markers 18*a* and 18*b* (FIG. 4). As will be understood by those skilled in the art, alternative, supplemental or additional paraphernalia may be utilized within the scope of the invention.

The participants include players whose positions are designated, for example, by indicia 20*a,* 20*b,* and 20*c.* and a dealer whose position is designated by indicia 22. For purposes of illustrating the present invention, only three players are shown; however, if more players were present, then they would be designated by numerals 20*d,* 20*e,* etc. The dealer is, for example, an employee of the gaming house, and the players are visitors or invitees thereto to play the game.

Figure 2:
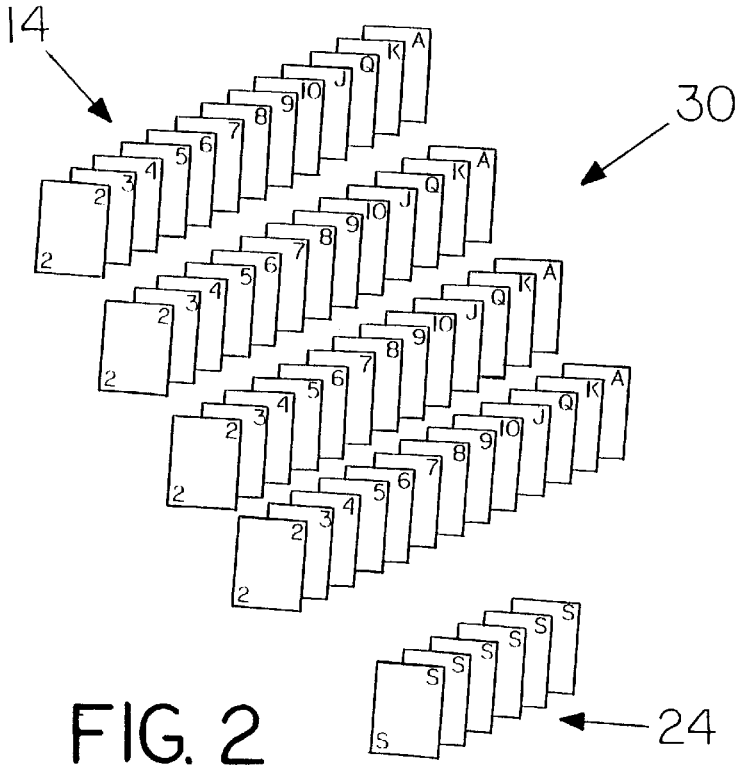

Playing pieces or cards 30 are of any media which have a display thereon of numbers, letters, designs and the like that are capable of establishing an order of prevalence for enabling play of the game. The order of prevalence is applied among hands comprising a set of at least two or more playing pieces whose aggregate score prevails over the aggregate score of another set of at least two or more playing pieces. Typically, the playing pieces or cards 30 display values representative of the numbers two through ten, and one or eleven. Special cards 24 are also included which represent any desired value. Most commonly, playing pieces or cards 30 comprise at least one standard fifty-two card deck 14 with the jokers removed. Multiple decks can be combined to make up the playing pieces or cards 30, generally eight to twelve decks, to reduce the delay incurred when the playing pieces or cards 30 need to be re-shuffled. There can be as few as just one special card 24 included in the playing pieces or cards 30, or as many as eight special cards 24 for each card deck combined in the playing pieces or cards 30. Jokers can be utilized as the special cards, if desired. For simplicity in describing the game, and not of limitation, the embodiment in FIG. 2 shows just one fifty-two card deck 14 with six special cards 24 comprising the playing pieces or cards 30. The special cards 24, when face down, are indistinguishable from any other cards in the deck. All number cards are valued at face value; kings, queens, jacks, are valued at ten; and aces are valued at 1 or 11. Special cards 24 are "wild", that is, they can represent any value the player holding the card desires. Jokers may be used as the special cards, if desired.

An action player and a banker player must be identified between participants 20*a,* 20*b,* and 20*c.* Typically two markers, action button 18*a* and banker button 18*b,* are respectively used to designate the action player and the banker player. Referring to the example in FIG. 1, participant 20*a* has the action button 18*a* and is therefore designated the action player and participant 20*b* has the banker button 18*b* and is therefor designated the banker player.

Preferably the selection of the banker player and the action player is accomplished by some random process. However, in some jurisdictions, the gaming house could be designated as the banker player, if desired. Selection device 16 may, for example, comprise a die, long and short straws, a random number generator, or any other suitable random means to select the action player and banker player. The selection of the banker player and the action player need not be accomplished by the same random process.

The gaming table is suitably shaped, such as, for example, having a horse shoe configuration which is typically found in gaming houses.

There may be as many participants as desired; however, a minimum of two is required in order to establish a banker player and an action player.

The dealer 22, who is preferably not an active player, and may be, for example, a member or employee of the gaming house, is responsible for controlling and determining the proper play of the game. The dealers duties include overseeing the selection of the action player and banker player, dealing the playing pieces, and applying the order of prevalence in settling wagers. Preferably the dealer does not act as the banker player and, in fact in some jurisdictions, is prohibited from doing so. In other jurisdictions, the dealer could participate as the banker player.

Figure 5:
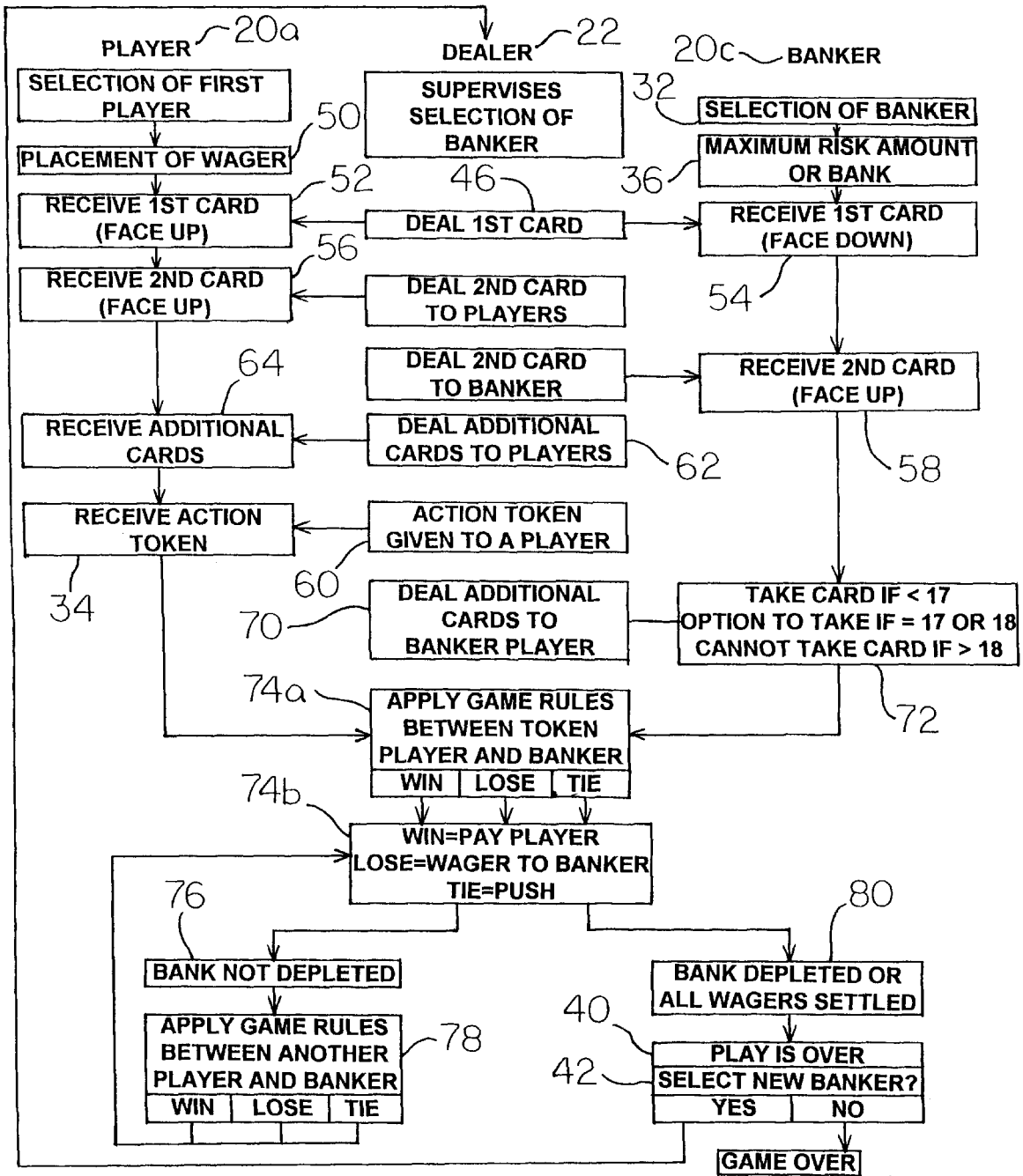
FIG. 5 is a flow diagram depicting a preferred and alternate play of the present invention.

Operation of the game preferably progresses in the order depicted, for example, in FIG. 5 and the boxes or enclosures therein. As an aid in understanding the following exposition, the illustrations in FIG. 5 are arranged in the following manner. Those operations relating to action player 20*a,* and later player 20*b,* are depicted, for example, in the left hand column of FIG. 5. Those operations relating to banker 20*c* are depicted, for example, in the right hand column of FIG. 5. Those operations relating to the dealer 22 are depicted, for example, in the center column of FIG. 5. Also shown in the center column are conditions of win, lose, and tie.

Before play commences, the banker player 20*c* is selected (enclosure 32). It is envisioned that the selection of the action player 20*a* could also be completed before play commences, however it is preferable to select the action player 20*a* (enclosure 60 and 34) after the second cards 26 have been dealt. The banker player 20*c* is selected when the selection device 16 is actuated (for example, a die could be rolled by the players, straws could be drawn by the players, or a random number generator could be activated). The banker marker or button 18*b* is then preferably placed before the selected participant by the dealer 22. However, even though the selection device designates a participant to be the banker player, that participant has the right to decline to be the banker player. The participant who agrees to become the banker player must outlay a maximum risk amount (enclosure 36) he is willing to lose to the other participants during a predetermined number of hands played by all the participants. The outlay of the maximum risk amount (enclosure 36) establishes bank 38 (FIG. 1). In some jurisdictions the banker player is limited to winning or losing an amount equal only to that amount he has placed in the bank. The participant who is the banker player 20*c*, remains as the banker player for a predetermined set number of hands are played, until the settlement of wages depletes the bank, or in some jurisdictions when the banker player has won or lost an amount equal that amount placed in the bank. In the embodiment depicted in FIG. 5, as long as the bank is not depleted during play, one hand is played by all participants before selecting a new banker (enclosure 42). More than one hand can be played by all participants before selecting a new banker, and hence this number can either be agreed to by the participants or controlled by house rules. Preferably, as depicted in FIG. 5, once the last set of hands is played, or when the bank is depleted, the play is over (enclosure 40). The game is over if none of the participants accept being the new banker player (enclosures 42 and 44). Preferably the new banker player is designated according to some predetermined order, such as a rotational order, or the like, established by house rules or by agreement of the participants. Again, the participant so designated as the new banker has the right to decline to be the banker and another participant can then be selected. Alternatively, the new banker can also be selected by some random process, such as the use of the random selection device 16.

After the bank 38 has been established (enclosure 36), wagers 48 are placed by the non-banker players (enclosure 50). Preferably the wagers 48 are placed before any playing pieces or cards 30 are dealt (enclosure 46).

Preferably, the sets of playing pieces or cards 30 are dealt one at a time in either a clockwise or counter-clockwise order so that each player receives one piece before any player receives a second piece. Alternatively, the first and second pieces can be dealt to one player, then first and second pieces can be dealt to another player, and so on, in either a clockwise or counterclockwise order. Other variations may be used, if desired.

In the alternate play of the present invention shown in FIG. 5, the dealer 22 deals a first playing card 25*a* face up to each player 20*a* and 20*b* (enclosure 52) and a first playing card 25*b* face down to the banker player 20*c* (enclosure 54). A second playing card 26 is dealt face up to all the players, including the banker player (enclosures 56 and 58). Preferably, the banker marker/button 18*b* is placed on the banker's playing pieces or cards.

In another alternate play of the present invention, all of the first playing cards (25*a* and 25*b* are respectively dealt face down to each player 20*a* and 20*b* and the banker player 20*c,* and all of the second playing cards 26 are respectively dealt face up to each player (20*a* and 20*b*) and the banker player 20*c*.

In still another alternate play of the present invention, all of the first playing cards (25*a* and 25*b*) are dealt face down respectively to each player (20*a* and 20*b*) and the banker player 20*c*, and the second playing cards 26 are respectively dealt down to each player (20*a* and 20*b*) and face up to the banker player 20*c*. Other combinations of dealing the cards can be used, according to the present invention, by agreement of the players or by house rules.

Each player, but preferably not the banker, looks at his first and second playing pieces or cards. Each player, but preferably not the banker player, may then request additional pieces or cards (28*a* and 28*b* in FIG. 1) (enclosures 62 and 64), as long as the aggregate total of their pieces or cards does not exceed a predesignated number. Generally, additional pieces or cards 28*a* (enclosure 62 and 64) are distributed, one player at a time, following the same clockwise or counter-clockwise order in which the first pieces were dealt.

Preferably once all the players, excluding the banker player, have been dealt additional pieces or cards 28*a*, the action player is then selected. According to the alternate play of the present invention as shown in FIG. 5, the action token 18*a* is given to a player (enclosure 60) who becomes the action player. The random selection device 16 can be used to select the player to be given the action token 18*a*. In one embodiment, the down card 25*b* of the banker player is turned up and its value is used to determine which player will be the action player. For instance, players can be counted in either a clockwise or counter-clockwise order starting from, for example, the banker player, until the count matches the value of the banker player's down card 25*b*, that has been turned up. The player in which this count ends on receives the action token 18*a*. Other procedures my be used for selecting the action player based on the value of the banker player's down card 25*b*, and such procedures can be determined by agreement of the players or by house rules. The player who receives the action player button 18*a* is the player whose hand and wager is first settled with the banker player. The action then rotates from that first player to the next player according to a predetermined order such as clockwise or counter-clockwise rotation. Because the game can end when the banker player's bank is depleted upon the settlement of a wager, not all players will necessarily get to play against the banker player in a given round. Hence, it is generally advantageous for the participants to obtain the action token and become the action player.

The banker player also has the opportunity to receive additional cards. The rules for dealing additional pieces or cards to the other players may also applied to the banker player (enclosure 70). Preferably however, in the alternate play of the present invention shown in FIG. 5, separate rules apply to the banker player for receiving additional cards (enclosure 72). The separate banker rules require the banker player to automatically accept additional cards 28*c* when his aggregate total is less than a predesignated range, and be automatically denied additional cards when his aggregate total is above the predesignated range. When the banker players aggregate total of his playing pieces or cards is within the predesignated range, he has the option to request or decline an additional card. Preferably, in this alternate play of the present invention, the predesignated number is twenty-one and the predesignated range is between seventeen and eighteen.

Starting with the action token player 20*a*, the players' wagers are settled against the bank of the banker player after all additional cards have been dealt. The wagers are settled by application of the order of prevalence (enclosures 74*a* and 74*b*). Once the wager of the action token player 20*a* has been settled with the banker player 20*c*, and if the bank is not depleted, action then rotates to the next player 20*b*. Preferably the action rotates according to a predetermined order of rotation. The predetermined order of rotation, for example, could be a clockwise or counter-clockwise rotation, or some other order as the house rules may provide.

In applying the order of prevalence to settle the wager of action player 20*a* against the banker player 20*c*, if the banker player wins he receives the wager 48 outlaid by the action player 20*a*. If the banker player loses he must, to satisfy the wager, give an amount of money or chips from the bank that equals the wager, to the action player 20*a*. If the total in the bank is insufficient to satisfy the wager 48 of the action player, the total in the bank 38 is given to the action player and play is concluded. If the action player 20*a* and the banker player 20*c* have the same order of prevalence, a tie or push is declared and the action player keeps his wager and the total in the bank remains unchanged. If the bank is not depleted (enclosure 76), play proceeds (enclosure 78) to the next player, here, player 20*b*. The action button may be moved to the next player as play progresses, or not, as the predetermined rules may provide. Once all hands are settled or when the bank is depleted (enclosure 80) play is over (enclosure 40).

In some jurisdictions the banker player may not win or lose an amount in excess of that amount initially placed in the bank. In these jurisdictions procedures are followed such that play is over when the banker player wins an amount equal to that amount initially placed in the bank, or when the banker player loses an amount equal to that amount initially placed in the bank.

The order of prevalence determines whether or not a player wins against the banker player. In one embodiment, a hand comprising just two special cards prevails over all hands, a hand comprising one special card and one ace card prevails next over any other hand, a hand whose aggregate score totals the predesignated number prevails next over any other hand, and when none of the above hands are held, the hand having the highest aggregate score prevails over any lower aggregate score hand. In another embodiment, a hand comprising just two special cards prevails over all hands, a hand whose aggregate score totals the predesignated number prevails next over any other hand, and when none of the above hands are held, the hand having the highest aggregate score prevails over any lower aggregate score hand. In still another embodiment, a hand comprising just two special cards prevails over all hands, a hand comprising one special card and any other card prevails next over any other hand, a hand comprising just two cards whose aggregate total equals the predesignated number prevails next over any other hand, a hand comprising three or more cards whose aggregate total equals the predesignated number prevails next over any other hand, and when none of the above hands are held, the hand having the highest aggregate score prevails over any lower aggregate score hand.

Preferably, in all these embodiments, a value of one or eleven points is assigned to ace cards, a value of ten is assigned to face cards, face value is assigned to numeric cards, and any desired value is assigned to special cards. Preferably, the predesignated number is twenty-one, however other numbers could be used as well.

A noteworthy aspect of the present invention is that all players have the possibility of winning after their hands have been established and before the banker player's hand is established. Hence, the severe consequences of "going over," which occurs in the game of Blackjack, is eliminated. As discussed above, players cannot obtain additional cards or pieces once the aggregate total of their hand exceeds a predesignated number, such as, twenty-one. However, when the aggregate total of their hand exceeds the predesignated number, for establishing the order of prevalence, a fixed numeric value, such as ten, is subtracted from the aggregate total to establish the aggregate score. This rule applies in determining the aggregate score of all the participants hands.

With the elimination of the "going over" situation, wherein a player has no possibility of winning because his aggregate score exceeds the predesignated number, it has been discovered the interest of the players are uniquely and unexpectedly risen. For example, consider that a player has an aggregate total of sixteen and is trying to decide whether or not to request an additional card wherein the predesignated number desired to be achieved is twenty-one. In this situation the most probable value of an additional card to be dealt is ten, and many times a player will decline to take an additional card, for going over eliminates any possibility of winning. This situation is common to the game of Blackjack. However, according to the present invention, this harsh result is eliminated for the player can accept an additional card, and still have a possibility of winning. Here, assuming he receives a card valued at ten, which is the most likely card to be dealt, his total aggregate score would remain at sixteen. If he receives a card valued at nine, his total aggregate score would be fifteen. Thus, the worst that could happen in deciding to select an additional card is that the players aggregate score could decrease, but he will always have a possibility of winning against the banker. This, it has been discovered, increases the interest of all players.

As will be understood by those skilled in the art, alternative, supplemental or additional steps and operations may be utilized within the scope of the invention.

Although the invention has been described with respect to particular embodiments thereof, it should be realized that various changes and modification may be made therein without departing from the spirit and scope of the invention and the accompanying claims.

What is claimed is:

1. A method of playing a game of chance and skill the object of which is for a player to acquire two or more playing cards or pieces whose aggregate score is greater than the aggregate score of cards or pieces held by a banker player where the aggregate scores cannot exceed twenty-one, requiring a minimum of two players, comprising the steps of:

utilizing playing cards or pieces including at least one special card, said playing cards or pieces being capable of establishing an order of prevalence in combination whose aggregate score enables a hand of two or more playing cards or pieces to prevail over another hand of two or more playing cards or pieces;

selecting one of the players as the banker player;

selecting a player other than the banker player as an action player;

placing wagers respectively by the players other than the banker player;

dealing one randomly selected first playing card to all players;

dealing one randomly selected second playing card to all players;

establishing a player hand for each player other than the banker player by dealing additional playing cards or pieces as requested by each such player other than the banker player, said additional playing cards or pieces dealt to each said player hand only as long as the aggregate total of each said player hand does not exceed twenty-one;

establishing a banker hand for the banker player by dealing additional playing cards or pieces to said banker hand according to predetermined rules;

determining the aggregate score of the banker hand and the aggregate score of the action player's player hand from the respective aggregate totals of their hands;

in determining the aggregate total of any player's player hand and the banker hand, assigning a numeric value for each different type of card or piece; and allowing said special card or piece to be any desired value;

in determining the aggregate score of any player's player hand and the banker hand, the aggregate score is the aggregate total of the assigned numeric values of the cards or pieces, or, if said aggregate total exceeds twenty-one, a value of ten is subtracted from the aggregate total to determine the aggregate score;

comparing the aggregate scores of the banker hand and the action player's player hand by applying an order of prevalence to determine a winner, said winner having an aggregate score having a higher order of prevalence than the other aggregate score;

in the event that the banker hand and the action player's player hand are of the same order of prevalence, the action player keeps his wager, at which time, play passes to a subsequent player who becomes the action player;

in the event that the banker hand has a higher order of prevalence than the actions player's player hand, giving the amount of the action player's wager to the banker player, at which time, play passes to a subsequent player who becomes the action player;

in the event that the action player's player hand has a higher order of prevalence than the banker hand, giving an amount to the action player equal to the amount of the action player's wager, at which time play passes to a subsequent player who becomes the action player;

terminating play when all of the players have played to the determination of an outcome;

in determining the aggregate total of any hand, assigning a value of one or eleven points for ace cards, a value of ten for face cards, face value for numeric cards, and any desired value for said special cards; and wherein in determining the order of prevalence between the banker hand and any other player's players hand, holding just two special cards prevails over all hands, holding one special card and one ace card prevails next over any other hand, any aggregate score hand totaling twenty-one prevails next over any other hand, and the highest value hand prevails over any lower value hand.

2. A method of playing a game of chance and skill according to claim 1 wherein said playing cards comprise a plurality of standard card decks.

3. A method of playing a game of chance and skill according to claim 2 wherein at least two and up to eight special cards are inserted into said playing cards or pieces for each standard card deck.

4. A method of playing a game of chance and skill according to claim 3 wherein said predetermined rules for dealing additional playing cards to said banker hand comprise;

an additional card must be taken when the aggregate total of said banker hand is less than seventeen, an addition card cannot be taken when the aggregate total of said banker hand is greater than eighteen, and, at the option of said banker player, an additional card may be taken when the aggregate total of said banker hand is either seventeen or eighteen.

5. A method of playing a game of chance and skill according to claim 4 wherein said first playing card of the banker player is dealt face down and said first playing cards of the other players are dealt face up.

6. A method of playing a game of chance and skill according to claim 5 wherein said second playing cards are dealt face up to all players.

7. A method of playing a game of chance and skill according to claim 6 wherein the first playing card of the banker player is exposed and the selection of the action player is determined according to the value of the first playing card of the banker player.

8. A method of playing a game of chance and skill according to claim 7 wherein the action player is selected after all other players have been furnished as many additional playing cards as requested.

9. A method of playing a game of chance and skill according to claim 8 wherein;

at the time the banker player is selected the banker player establishes a bank by placing a maximum amount wager which he is willing to risk to lose to the other players;

in the event that the action player's hand has a higher order of prevalence than the banker's players hand, funds are withdrawn from said bank to equal the action player's wager; and, wherein play is also terminated in the event said bank is depleted.

10. A method of playing a game of chance and skill the object of which is for a player to acquire two or more playing cards or pieces whose aggregate score is greater than the aggregate score of cards or pieces held by a banker player where the aggregate scores cannot exceed twenty-one, requiring a minimum of two players, comprising the steps of:

utilizing playing cards or pieces including at least one special card, said playing cards or pieces being capable of establishing an order of prevalence in combination whose aggregate score enables a hand of two or more playing cards or pieces to prevail over another hand of two or more playing cards or pieces;

selecting one of the players as the banker player;

selecting a player other than the banker player as an action player;

placing wagers respectively by the players other than the banker player;

dealing one randomly selected first playing card to all players;

dealing one randomly selected second playing card to all players;

establishing a player hand for each player other than the banker player by dealing additional playing cards or pieces as requested by each such player other than the banker player, said additional playing cards or pieces dealt to each said player hand only as long as the aggregate total of each said player hand does not exceed said twenty-one;

establishing a banker hand for the banker player by dealing additional playing cards or pieces to said banker hand according to predetermined rules;

determining the aggregate score of the banker hand and the aggregate score of the action player's player hand from the respective aggregate totals of their hands;

in determining the aggregate total of any player's player hand and the banker hand, assigning a numeric value for each different type of card or piece; and allowing said special card or piece to be any desired value;

in determining the aggregate score of any player's player hand and the banker hand, the aggregate score is the aggregate total of the assigned numeric values of the cards or pieces, or, if said aggregate total exceeds said twenty-one, a value of ten is subtracted from the aggregate total to determine the aggregate score;

comparing the aggregate scores of the banker hand and the action player's player hand by applying an order of prevalence to determine a winner, said winner having an aggregate score having a higher order of prevalence than the other aggregate score;

in the event that the banker hand and the action player's player hand are of the same order of prevalence, the action player keeps his wager, at which time, play passes to a subsequent player who becomes the action player;

in the event that the banker hand has a higher order of prevalence than the actions player's player hand, giving the amount of the action player's wager to the banker player, at which time, play passes to a subsequent player who becomes the action player;

in the event that the action player's player hand has a higher order of prevalence than the banker player's hand, giving an amount to the action player equal to the amount of the action player's wager, at which time, play passes to a subsequent player who becomes the action player;

terminating play when all of the players have played to the determination of an outcome;

in determining the aggregate total of any hand, assigning a value of one or eleven points for ace cards, a value of ten for face cards, face value for numeric cards, and any desired value for said special cards; and wherein in determining the order of prevalence between the banker hand and any other player's players hand, holding just two special cards prevails over all hands, any aggregate score hand totaling said twenty-one prevails next over any other hand, and the highest value hand prevails over any lower value hand.

11. A method of playing a game of chance and skill according to claim 10 wherein said playing cards or pieces comprise a plurality of standard card decks.

12. A method of playing a game of chance and skill according to claim 11 wherein at least two and up to eight special cards are inserted into said playing cards or pieces for each standard card deck.

13. A method of playing a game of chance and skill according to claim 12 wherein said predetermined rules for dealing additional playing cards to said banker hand comprise;

an additional card must be taken when the aggregate total of said banker hand is less than seventeen, an addition card cannot be taken when the aggregate total of said banker hand is greater than eighteen, and, at the option of said banker player, an additional card may be taken when the aggregate total of said banker hand is either seventeen or eighteen.

14. A method of playing a game of chance and skill according to claim 13 wherein said first playing card of the banker player is dealt face down and said first playing cards of the other players are dealt face up.

15. A method of playing a game of chance and skill according to claim 14 wherein said second playing cards are dealt face up to all players.

16. A method of playing a game of chance and skill according to claim 15 wherein the first playing card of the banker player is exposed and the selection of the action player is determined according to the value of the first playing card of the banker player.

17. A method of playing a game of chance and skill according to claim 16 wherein the action player is selected after all other players have been furnished as many additional playing cards as requested.

18. A method of playing a game of chance and skill according to claim 17 wherein;

at the time the banker player is selected the banker player establishes a bank by placing a maximum amount wager which he is willing to risk to lose to the other players;

in the event that the action player's hand has a higher order of prevalence than the banker's players hand, funds are withdrawn from said bank to equal the action player's wager; and, wherein play is also terminated in the event said bank is depleted.

* * * * *